US006247962B1

(12) United States Patent
DeSorbo

(10) Patent No.: US 6,247,962 B1
(45) Date of Patent: Jun. 19, 2001

(54) BATTERY PACK CONNECTION ADAPTER

(75) Inventor: Alex DeSorbo, Woodbury, CT (US)

(73) Assignee: Anton/Bauer, Inc., Shelton, CT (US)

( * ) Notice: Subject to any disclaimer, the term of this patent is extended or adjusted under 35 U.S.C. 154(b) by 0 days.

(21) Appl. No.: 09/551,360

(22) Filed: Apr. 18, 2000

Related U.S. Application Data

(60) Provisional application No. 60/129,864, filed on Apr. 19, 1999.

(51) Int. Cl.[7] ..... H01R 3/00
(52) U.S. Cl. ..... 439/500; 439/170; 439/342
(58) Field of Search ..... 439/342, 343, 439/345, 170, 500

(56) References Cited

U.S. PATENT DOCUMENTS 4,218,107 * 8/1980 Wilson ..... 439/342
4,550,968 * 11/1985 Corrigan ..... 439/345
4,810,204 * 3/1989 Wilson ..... 439/343
4,822,296 * 4/1989 Wilson ..... 439/343
6,102,725 * 8/2000 Panagiotou ..... 439/342

* cited by examiner

*Primary Examiner*—Tulsidas Patel
*Assistant Examiner*—Hae Moon Hyeon
(74) *Attorney, Agent, or Firm*—Allen D. Brufsky

(57) ABSTRACT

An adapter plate for an electrical connection between a battery charger and battery pack. The adapter plate includes a partially conductive strip. The pattern of conductive material on the strip is such as to establish a circuit between underlying electrical contact pins on either the charger or battery pack so as to render the charger compatible with and capable of charging the battery pack.

8 Claims, 10 Drawing Sheets

101
19
19
206
208
70
209
202
204
16
200
11
11A
117
15
115
42
15
15

101
19
19
206
300
70
209
210
204
302
202
11A
117
15
115
42
15
15

101
19
19
402
400
70
209
204
206
16
202
11A
117
15
115
42
15
15

500
70
502
11A
19
101
117
19
115
42
15

BATTERY PACK CONNECTION ADAPTER

CROSS-REFERENCES TO RELATED APPLICATIONS

This application is based on provisional application, Ser. No. 60/129,864, filed Apr. 19, 1999, to the same inventor as the present application, and claims priority from that date.

BACKGROUND OF THE INVENTION

1. Field of the Invention

This invention relates to an adapter plate for an electrical connection, and more particularly, a multi-function electrical connection between a battery charger or the like and a battery pack having a plurality of interacting electrical contact pins.

2. Description of Prior Art

In U.S. Pat. No. 4,218,107, assigned to the same assignee as the present invention, a battery pack connection was disclosed which includes a female plate that is secured, for example, directly to a portable device such as a battery charger. The female plate is formed with a plurality of keyholes together with at least one male terminal with the keyholes and the terminal extending in the same direction but with the terminal being positioned within a recess spaced beneath the plane of the female plate. A male plate cooperates with the female plate and may form one side of a battery containing receptacle or pact. The male plate has a plurality of circular headed projections extending therefrom and at least one female terminal positioned within a housing that projects from the plane of the male plate.

In use, the female plate is fixed and connected to the electrical charger device and if the male plate is part of the battery pack, the user positions the male plate against the female plate with initial alignment occurring between the recess and the housing and with said alignment preventing lateral shifting of the plate with respect to the slots of the keyholes. The use can then only move the male plate in the direction of the keyhole slots until the headed projections enter into circular openings of the keyholes. The male plate is then further moved to position the projections within the slots of the keyholes with said movement causing electrical connection between the male and female terminals, so that the battery pack carried by the male plate may be recharged.

When the male plate has achieved its connected position, a tensioned flexible strip that is positioned behind one keyhole reverts to its normally biased position wherein it has a ledge which engages the head of the projection in said keyhole and prevents the two plates from moving from their connected position.

For removing the plate, the user merely bends the flexible strip from its normal position which unlocks the engagement between the strip and the projection to thereby permit the male plate to be moved so as to position the headed projections within the circular openings of the keyholes. At this position, the terminals have been disconnected and the male plate can be removed from the female plate.

In an improved battery pack connection disclosed in U.S. patent application Ser. No. 068,350, filed Jul. 1, 1987, now U.S. Pat. No. 4,810,204 entitled Battery Pack Connection, assigned to the same assignee as the present invention, the flexible locking strip is replaced by a positive, thumb-actuated pivoted locking mechanism having a locking pin adapted to be positioned over one of the threaded projections on the male plate after it is seated in the slot portion of a corresponding keyhole slot in the female plate. Upon pivoting of the mechanism with one hand, the pin can be removed from the path of movement of the head in the keyhole slot against the bias of a spring which provides a tactile feel upon opening and pivoting of the locking mechanism immediately conveying the position of the locking mechanism to the user that there is an unobstructed path of movement or clear keyhole slot. With the other hand, the entire male plate and headed projections can be moved up and out of corresponding closed keyhole slots, breaking the electrical connection between the terminal contacts on the male and female plates, and permitting the male plate and its batteries to be replaced by another pack or interchanged with another male plate containing a battery pack to be recharged, by reversing the procedure and repivoting and seating the locking pin over one of the headed projections. This is accomplished by simply releasing the locking mechanism, which is repositioned upon release by the return force of the leaf spring.

Additionally, instead of molding the female and male plates completely in one piece including support structure for the female and male contact terminals, respectively, on each plate, the terminals are provided on removable and adjustable terminal blocks for ease of assembly with wire connections exterior of the plates.

The female terminal block is adapted to be slid into the male plate with a U-shaped opening surrounding a stationary post. The upper and lower edges of the block are confined between upper and lower support shoulders forming a groove, which allows the connector block a specified amount of movement in all directions on a horizontal plane. This arrangement also permits preassembly of the contacts in the block and their attachment to wire connections with the battery associated with the male plate, exterior to the male plate, and once the block is slid into place on the male plate and the plate connected in turn to the female plate, the female contact terminals accepting the male contact terminals will self-align and make appropriate contact. This removes the necessity of precisely molding the contact placements in both the male and female plates.

Similarly, the male terminal block in the female plate can be separated from the female plate and slid onto the plate from the rear, riding over a cantilevered spring finger which snaps back positioning a shoulder behind the bottom edge of the block to hold it in place. Shoulders on the interior of the female plate limit inward sliding movement of the block. Male terminal contact pins can then be used to threadedly secure and lock the block against movement to the interior of the plate. As with the female connector block, the removability of the block allows assembly of electrical wiring from the device power is to be supplied to, exteriorly of the female plate. This invention relates to this electrical connection between the male and female terminal blocks, their pin mountings, the pin functions, and the manner in which the pins are activated.

In U.S. Pat. No. 4,822,296, also assigned to the same assignee as the present invention, the electrical connection includes an electrical connector block provide on a female plate secured to an electrical device, such as a battery charger, although the female plate can be connected to a device, e.g., a camera or other portable device, which can be used to obtain and discharge power from a battery, rather than a device to charge a battery. A battery pack mounted on a male plate is releasably locked to the female plate and has electrical contacts in electrical communication with the battery pack to, for example, remove a charge from the battery charger to the battery pack or to establish a power connection to drive an electrical device, For purposes of discussions to follow, it will be assumed that the female plate is mounted on a battery charger, unless otherwise indicated, to recharge a battery pack carried on a male plate.

Upon locking the male plate to the female plate, the electrical contacts on the male plate are brought into electrical engagement with a plurality of contact pins on the electrical connector block mounted on the female plate. The outermost pins on the electrical connector block are expandable banana plugs providing a positive (+) and a negative (−) circuit connection to allow powering of a device by a battery/power supply or recharging of a battery carried by the male plate and are received in cylindrical tubular contact elements on the male plate. The remaining pins on the female connector block all comprise a piston adapted to move linearly within a cylinder against the bias of a coil spring. The piston head may be enlarged for contact with a correspondingly located tubular pin or terminal carried by the male plate or may have a reduced diameter portion to conserve space, which extends upwardly to effect the requisite contact with a solid contact pin.

Upon depression of the piston against the bias of the coil spring within its cylinder by one of the contact pins on the male plate, an electrical circuit can be established through the piston in sliding engagement with its cylinder. Each cylinder can be electrically connected to one or more charger circuits, which circuit can be used to energize a display, e.g., of a gauge to visually record the remaining voltage in the battery pack as it is charged or before recharging, if necessary. Another pin can be used to energize a circuit to enable a temperature responsive cut-off circuit in the charger to be activated so that the charger will not overheat when in use. Another one of the remaining contacts may, e.g., be used to establish an electrical circuit directly from the battery pack being recharged through its cylinder to sense whether the battery is resistor encoded or of a certain type compatible with the charger. The remaining pin can be used for a similar, albeit different communication between the battery pack and charger, e.g., to provide an analog output indicative of the remaining capacity in the battery, prior to recharging. The springs within each cylinder, upon depression, assure the maintenance of electrical contact between each piston and its corresponding contact pin on the male plate and allow depression of a contact on the female plate even in the absence of a corresponding pin on the male plate to establish a circuit at that location, so the female plate and its electrical connectors are compatible with a male plate provided with less circuits and function capability.

SUMMARY OF THE INVENTION

Older type battery packs, as disclosed in U.S. Pat. No. 4,218,107 may be devoid of pins necessary to establish the above noted circuits and thus incompatible with the battery charger, as, e.g., the charger cannot identify that the battery is resistor encoded and thus of the type compatible with the charger. In order to overcome this problem, an adapter plate is provided for the battery pack connection including a partially conductive strip, containing in one embodiment, a resistor, which can be mounted on the female plate connector block. The pattern of conductive material on the strip is such as establish a circuit between the underlying pins on the connector block through the resistor so as to render the charger capable of charging the battery pack through the banana pins. The adapter plate thus enables the pins which are the subject of the disclosure in the U.S. Pat. No. 4,822,296 patent to be obviated by moving the female plate pins in line with and compatible with the construction contemplated in U.S. Pat. No. 4,218,107.

The plate may take other forms and have different pins and/or contact points for establishing circuits to other battery pack types or the mechanical relationships between pins may be varied on both the female connector block and male terminal block by use of the adapter plate mounted thereon.

BRIEF DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENT

Figure 1:
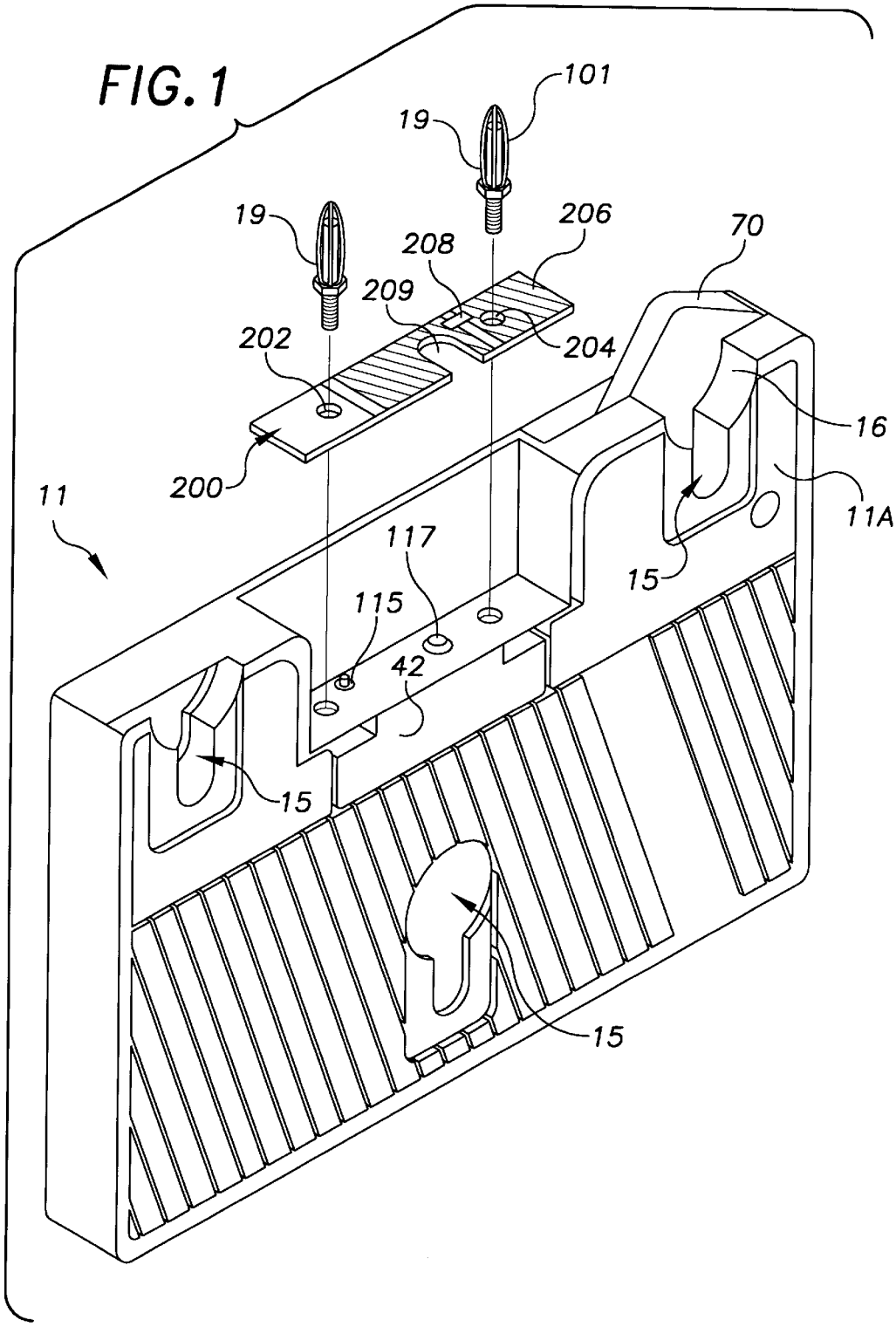
FIG. 1 is an exploded perspective view of the female plate of a electrical connection provided with one form of adapter plate in accordance with the present invention.
Figure 2:
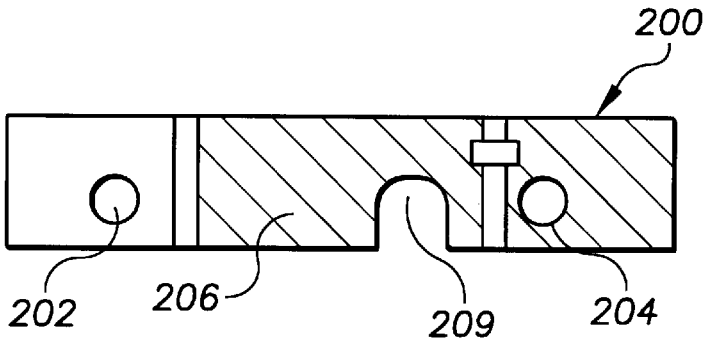
FIG. 2 is a top view in elevation of the adapter plate of FIG. 2.
Figure 3:
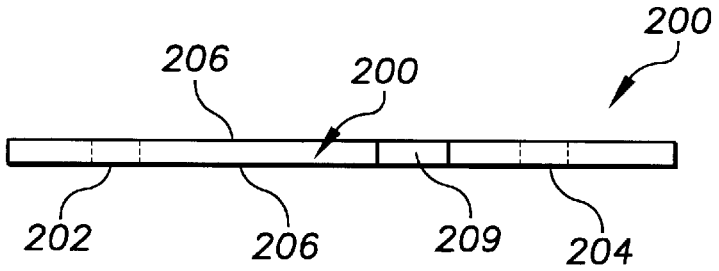
FIG. 3 is a side view in elevation of the adapter plate of FIG. 3.

Referring now to the drawings in detail, wherein like numerals indicate like elements throughout the several views, a female battery pack connector bracket is generally indicated by the reference numeral 11 in FIG. 1.

The plate 11 and its operation are described in detail in prior art patent U.S. Pat. No. 4,822,296 assigned to the same assignee as the instant invention.

Figure 4:
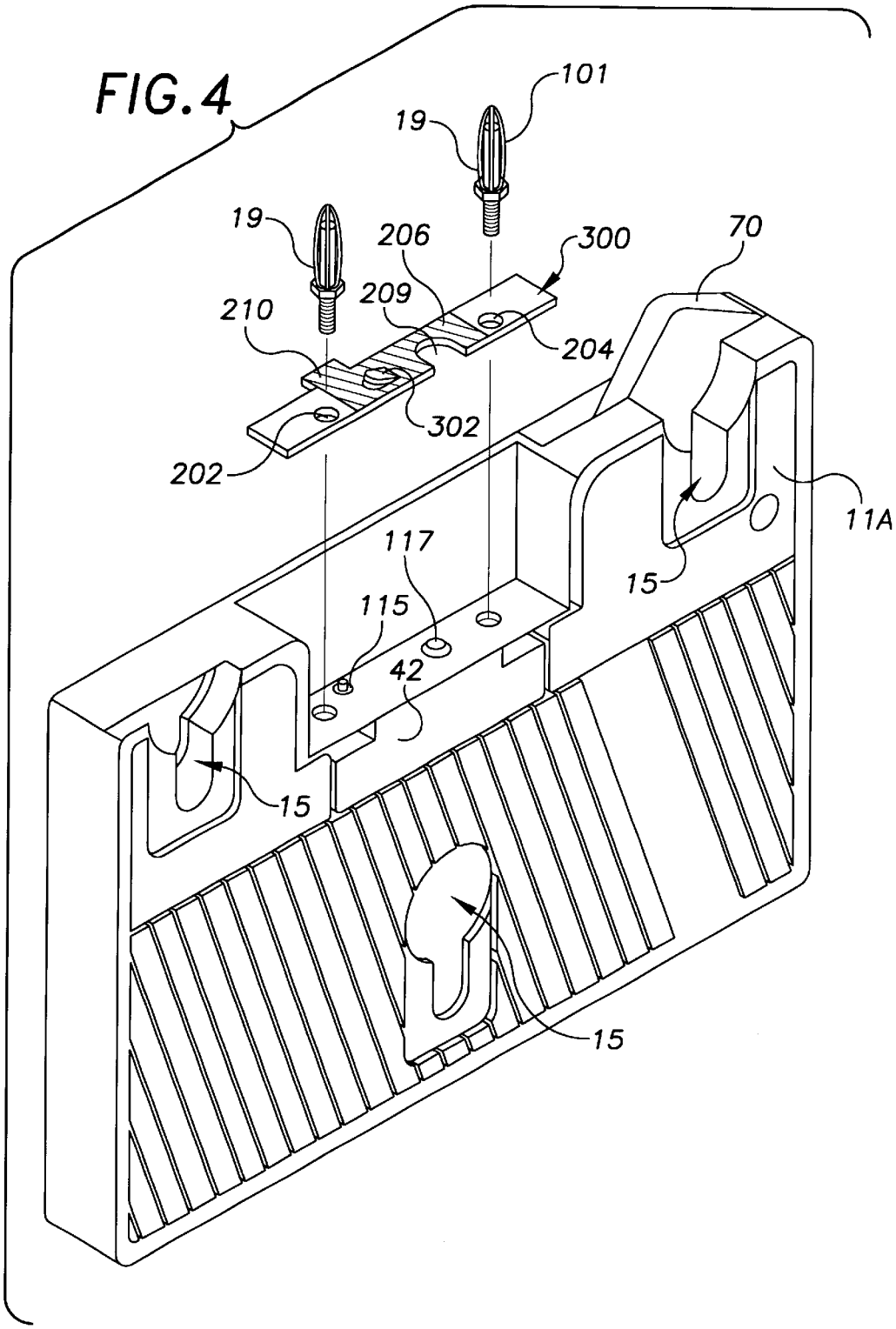
FIG. 4 is an exploded perspective view of the female plate provided with another form of adapter plate.
Figure 7:
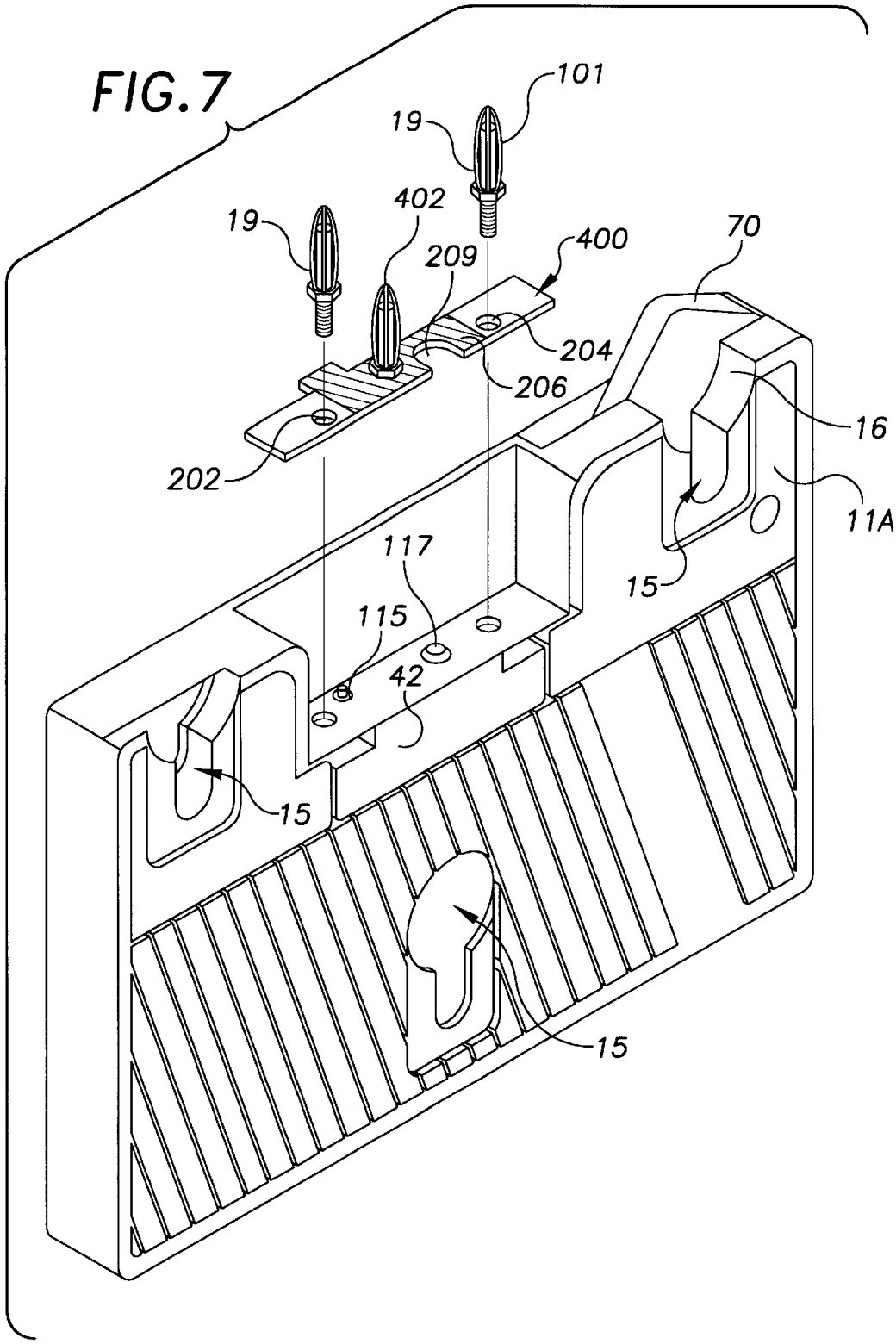
FIG. 7 is an exploded perspective view of the female plate provided with still another form of adapter plate.

FIGS. 1, 4, and 7 show a female-type plate 11A provided with four pins in the connector block 42 to illustrate the principles of the invention, although it should be understood that up to six pins may be used. Also the headed pin 117 has been placed in an unused connection position on block 42 or one provided for future use. The outermost pins 19 with enlargeable heads 101 on the electrical connector block 42 are expandable banana plugs providing a positive (+) and a negative (−) circuit connection to a source of power through the battery charger to recharge the batteries carried by the male plate and are received in conductive tubular contact elements 111 in block 31 wired to the battery pack being recharged. The fourth pin 115 on block 42 is used to establish yet another circuit, e.g., to sense whether the battery parameters are compatible with the charger or of a type for optimum charging, or to energize a temperature responsive cut-off circuit in the charger so that the battery will not overheat in the charging process, or can even be used to energize a display indicative of the remaining voltage before and after charging. For example, the reduced diameter pin 115 is most likely to be used to establish an electrical circuit directly from the battery pack being recharged through a solid pin 113 on block 31 to sense whether the battery is resistor encoded which is indicative of the type compatible with the charger.

Older type battery packs, as disclosed in U.S. Pat. No. 4,218,107 may be devoid of pins necessary to establish the above noted circuits and thus incompatible with the battery charger, in that the charger cannot identify that the battery is resistor encoded and thus of the type compatible with the charger. In order to overcome this problem, an adapter plate 200 (FIG. 1) may be provided for seating on top of terminal block 42 having holes 202, 204, at opposite ends for passage of the banana plugs 19 there through. The plate has a conductive strip of material 206, such as copper powder, deposited thereon partially throughout its length at preselected locations on its top and bottom surface and can contain an electrical resistance element 208 embedded therein. The strip of material 206 has a semicircular cutout 209 for surrounding the unused pin 117, but the conductive strip 206 is placed in electrical contact with pin 115, even though the pins 19 and 115 are not in horizontal alignment. A battery sensing circuit can thus be established via one of the pins 19, conductive strip 206 and pin 115 even though there is no mating pin in place on the male terminal for contact with pin 115, which would be the case for older type, two-pin battery packs, and charging through the banana pins can take place.

Figure 5:
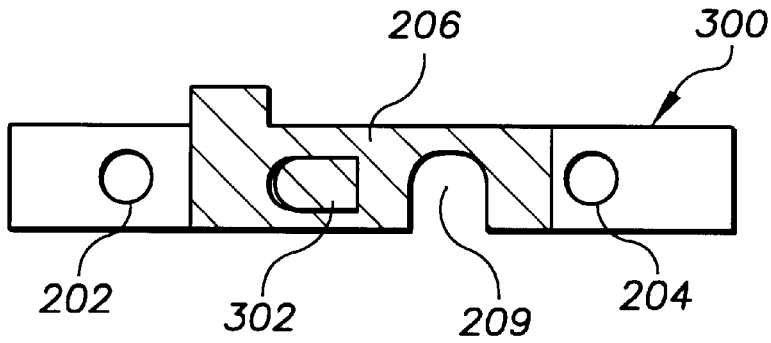
FIG. 5 is a top plan view of the adapter plate of FIG. 4.
Figure 6:
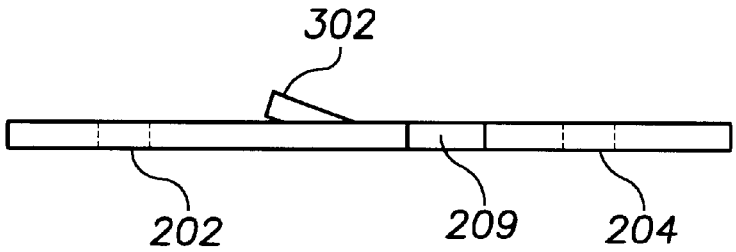
FIG. 6 is a side view in elevation of the adapter plate of FIG. 5.

The adapter plate 300 illustrated in FIGS. 4 to 6 inclusive includes the same holes 202, 204, 209, but is narrower in width than the plate 200 to assure that it will fit in the space in the female bracket above the block 42. The conductive strip 206, however, has an extension 210 for electrical contact with pin 115 and forms an L-shaped arm. An upraised electrically active spring contact 302 is cantilevered from the strip section 206 out of the plane of the plate 300. The spring contact or finger 302 allows for vertical, in-line contact with a pin on the male plate terminal block 31, but yet permits the sensing circuit through pin 115 to be established. In this embodiment, the conductive strip does not embrace one of the pins to establish electrical contact therewith, but two separate circuits are established.

Figure 8:
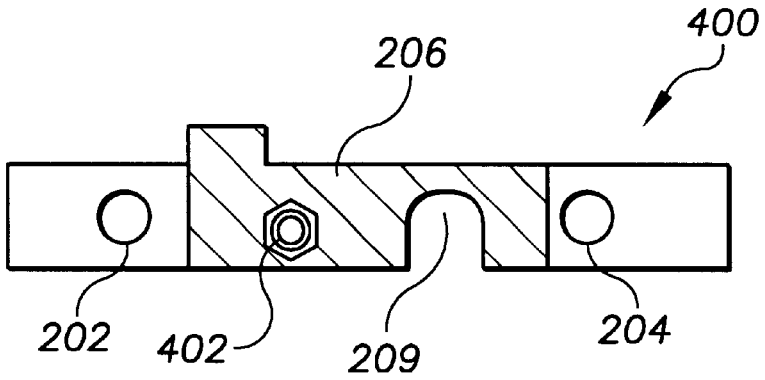
FIG. 8 is a top view in elevation of the adapter plate of FIG. 7.
Figure 9:
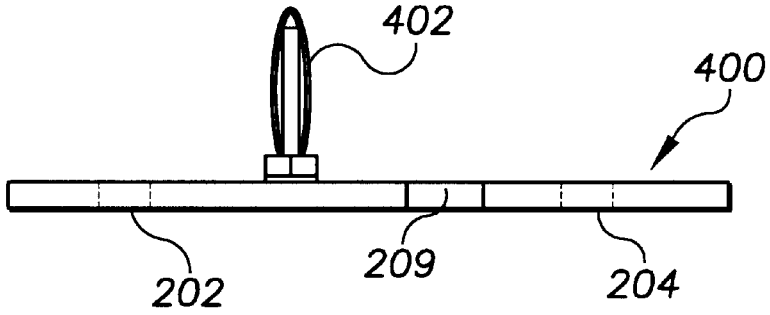
FIG. 9 is a side view in elevation of the adapter plate of FIG. 8.

The adapter plate 400 illustrated in FIGS. 7 to 9, inclusive is identical in configuration to adapter plate 300, except that the spring finger contact is replaced by a rigid banana plug pin 402 to establish the sensing circuit.

Figure 10:
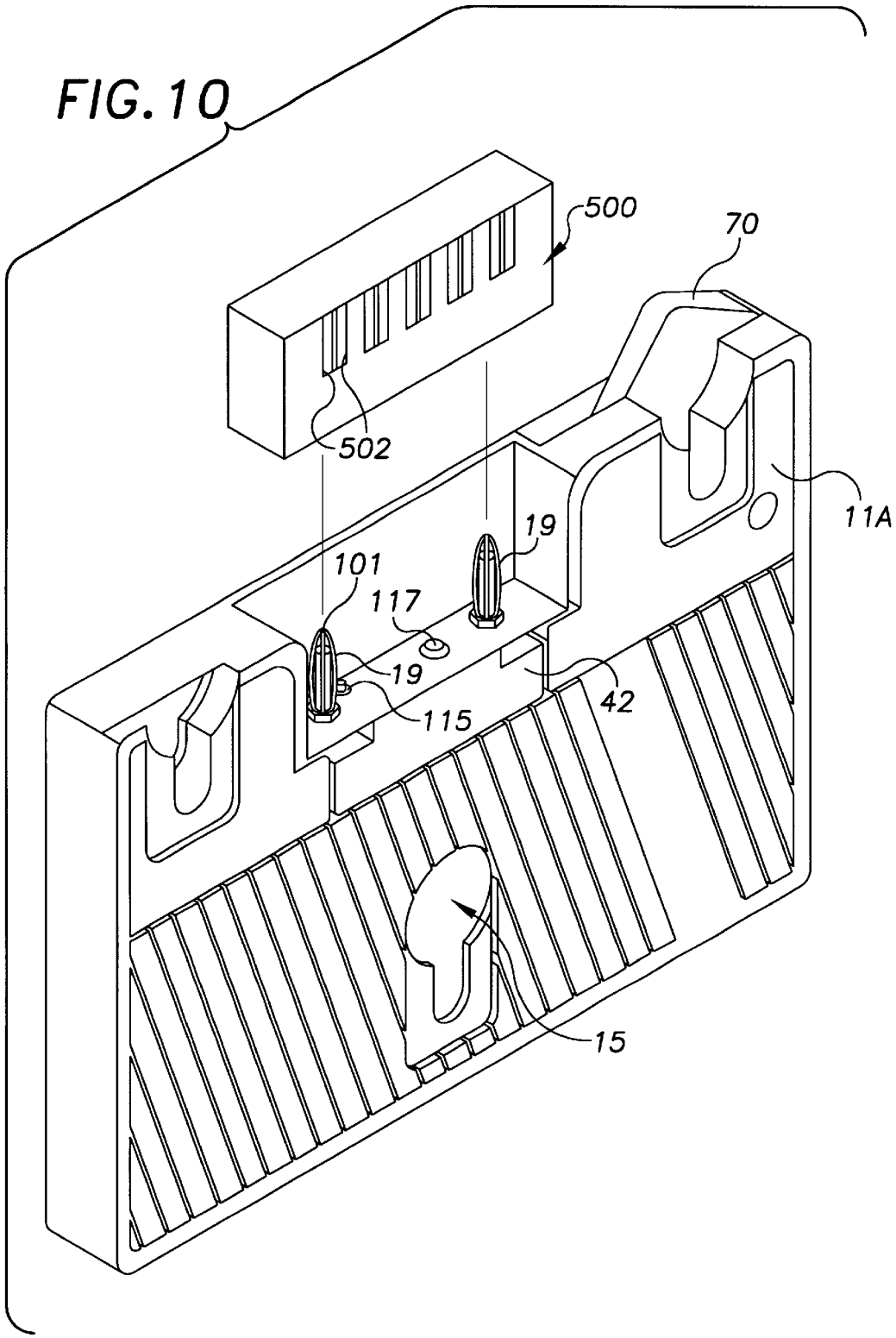
FIG. 10 is an exploded perspective view of the female plate provided with yet another form of adapter plate or block to connect the female plate to a different style male battery plate.
Figure 11:
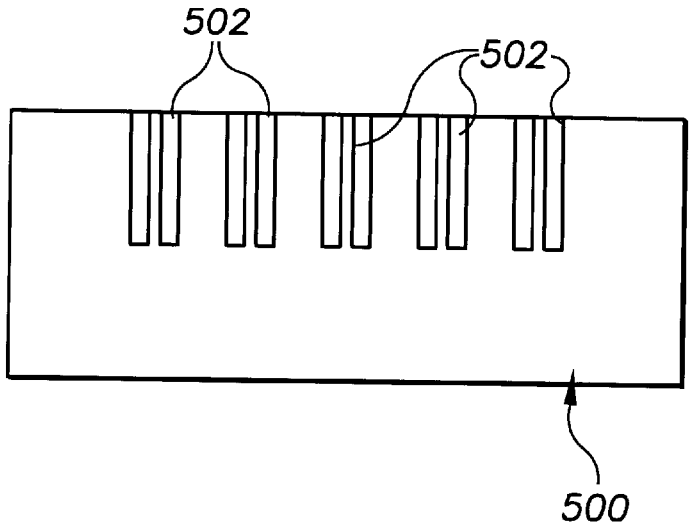
FIG. 11 is a front view in elevation of the block of FIG. 10.
Figure 12:
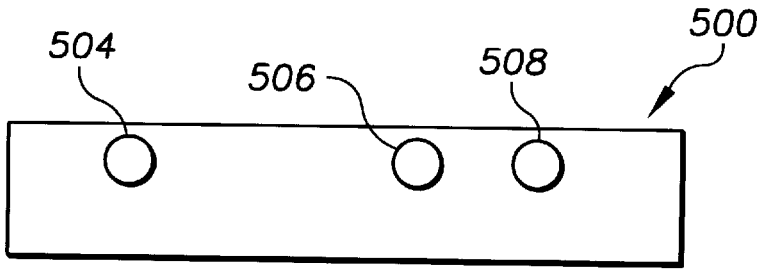
FIG. 12 is a bottom plan view of the block of FIG. 11.

An adapter plate or block 500 illustrated in FIGS. 10 to 12 is used to attach a completely different battery style male plate to the female plate 11A; one that includes contacts which establish a circuit through vertical mating conductive strips 502 on the block 500 connected to conducting tubes 504,506 and 508 embedded in block 500, which mate with banana pins 19 and either pins 115 or 117 to establish a sensing circuit.

Figure 13:
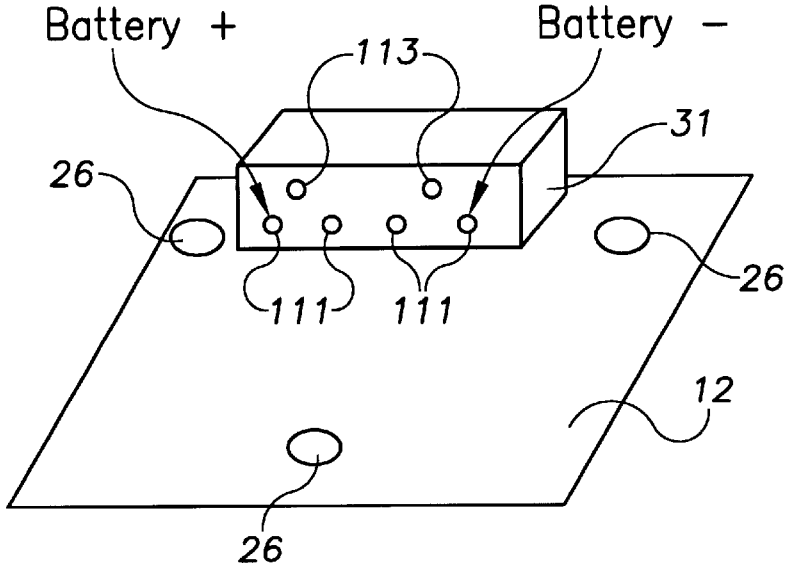
FIGS. 13, 13A and 13B are schematic representations of the male plate of the electrical connection illustrating the use of one or more adapter plates formed in accordance with the invention on the terminal block on the male plate.
Figure 13A:
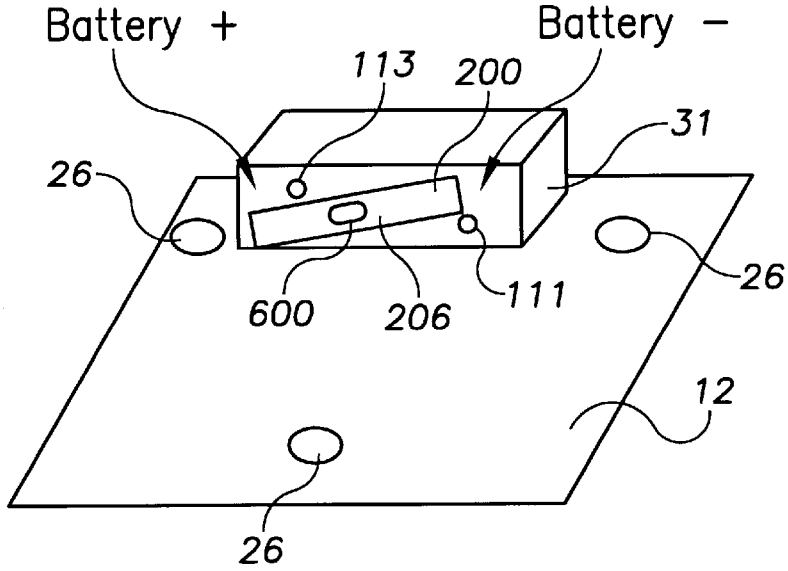
Figure 13B:
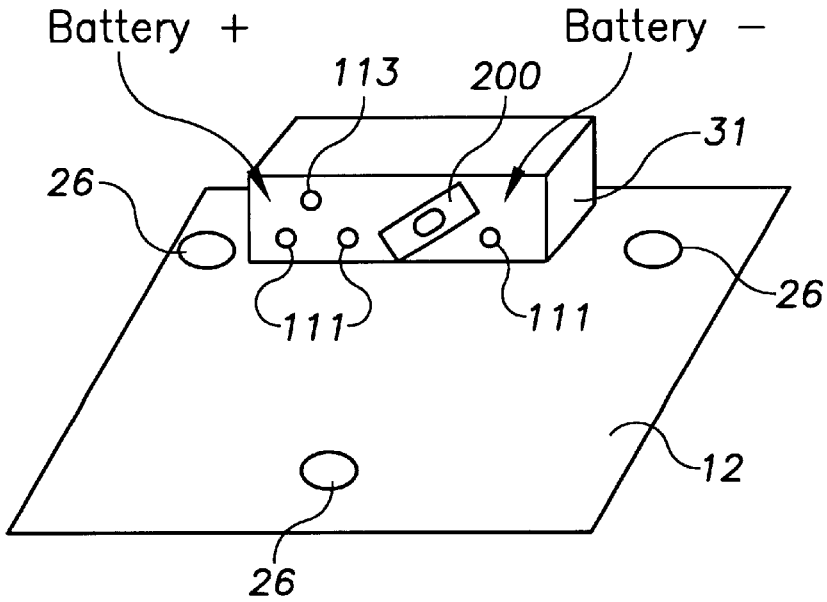

FIG. 13 is a schematic diagram illustrating the pin configuration on the bottom of the male terminal block 31. Six pins and their function is illustrated. These pins correspond to the pins 111 and 113 disclosed in U.S. Pat. No. 4,822,296. One of the adapter plates 200, 300, 400, 500 or the like is used to bridge selected ones of the contact pins 111, 113 across the bottom of the block 31 around the conductive tubes for the pins as illustrated in FIG. 13A. For example, an adapter plate 200 with resistor and thermal sensor 600 in contact with the thermal sensor pin 111 embedded in the conductive strip portion 206 is positioned between the (+) banana pin 19 across the thermal sensor pin and battery type sensing pin 113 to activate these circuits without corresponding pins in line or not on the female connector block 42. In FIG. 13B an adaptor plate 200 can bridge the unused pin 111 and battery type sense pin 113 so as enable circuits to be established whether the female plate connector block is provided with just banana pins 19, since the sense circuit is continuously activated or with a six pin configuration the conductive strip provides the electrical path between the contacts. The adapter plates of the present invention thus enable the establishment of an electrical connection of almost any battery pack to the charger having a female plate as disclosed.

What is claimed is:

1. In an electrical connection having a relatively flat male plate, and a relatively flat female plate, said plates being releasably locked together in connected condition, said female plate including an open top recess being adapted to contain a plurality of elongated electrical terminals, a connector block being releasably received in and locked to said open top recess, said connector block containing a plurality of depending slots formed therein, and a plurality of elongated terminals being elongated in the same direction as said slots;

said male plate including a housing having an opening extending outwardly from said male plate, said housing being adapted to contain a plurality of elongated mating electrical terminals, a terminal block being releasably received in and locked to said opening in the male plate, a plurality of spaced headed projections with there being one for each slot and with each projection having head and leg portions, and elongated mating electrical terminals, at least some of which correspond in location to the electrical terminals on said connector block when said plates are releasably locked together, and said male plate being positioned abutting the female plate with a leg of each of the projections being located in an associated slot and with the elongated electrical terminals on said connector block in contact with the mating electrical terminals on said terminal block, and said elongated electrical terminals on said connector block including:

(1) a pair of terminals having a fixed head in the direction of said depending slots located in individual recesses in said connector block, and (2) at least one terminal having a movable head in the direction of said depending slots the corresponding mating electrical terminals on said terminal block receiving the fixed heads on said terminals of said connector block and an adapter plate between said fixed heads on said terminals of said connector block having a substantially planar conductive strip:

(1) overlying and in electrical contact with at least one other terminal on said connector block, or (2) bridging the space between other, selectively provided, electrical terminals on said terminal block to establish an electrical circuit through said fixed heads, conductive strip and other terminal or terminals.

2. In the electrical connection of claim 1, said adapter plate including:

an additional contact element extending upwardly from the plane of said conductive strip.

3. In the electrical connection of claim 2 said additional electrical contact is a spring finger.

4. In the electrical connection of claim 1, said conductive strip is substantially L-shaped.

5. In the electrical connection of claim 1, said conductive strip includes a resistor embedded therein.

6. In the electrical connection of claim 1, said conductive strip includes a thermally responsive electrical element.

7. In the electrical connection of claim 1, said adapter plate is a rectangular block provided with a plurality of conductive contact strips.

8. In the electrical connection of claim 1, including an additional cutout formed in said plate to prevent contact with an inactive terminal.

* * * * *